United States Patent [19]

Dropczynski et al.

[11] Patent Number: 4,552,316

[45] Date of Patent: Nov. 12, 1985

[54] METHOD AND APPARATUS FOR WINDING WEBS OF CELLULOSE

[75] Inventors: Hartmut Dropczynski, Dormagen; Peter Trilling, Wuppertal, both of Fed. Rep. of Germany

[73] Assignee: Jagenberg AG, Dusseldorf, Fed. Rep. of Germany

[21] Appl. No.: 558,086

[22] Filed: Dec. 5, 1983

[30] Foreign Application Priority Data

Dec. 4, 1982 [DE] Fed. Rep. of Germany ..... 3244966

[51] Int. Cl.[4] ..... B65H 19/20; B65H 17/08

[52] U.S. Cl. ..... 242/56 R; 242/66

[58] Field of Search ..... 242/56 R, 66, 65; 156/190, 193, 506, 524, 529, 533, 640; 225/1, 2, 93, 94

[56] References Cited

U.S. PATENT DOCUMENTS 2,512,414 6/1950 Booth ..... 225/2

3,666,151 5/1972 Dyer et al. ..... 225/2

FOREIGN PATENT DOCUMENTS 2709684 9/1977 Fed. Rep. of Germany .

750112 6/1956 United Kingdom ..... 242/56 R

*Primary Examiner*—Leonard D. Christian

*Attorney, Agent, or Firm*—Sprung, Horn, Kramer & Woods

[57] ABSTRACT

A method of winding webs of cellulose on core tubes, wherein the web, which is subjected to tension, is separated by being wetted along a line across the direction in which the web travels at a point that ensures that the core tube will be completely looped. A two-drum winding machine with contact roll and web-separating mechanism for winding webs of cellulose is provided with a hollow separating strip that extends across the whole width of the machine and has water outlets along its blade.

4 Claims, 2 Drawing Figures

METHOD AND APPARATUS FOR WINDING WEBS OF CELLULOSE

BACKGROUND OF THE INVENTION

The present invention relates to a method of winding webs of cellulose on core tubes and to a two-drum winding machine with means of carrying out the method.

It has previously been common when changing rolls to separate the cellulose web manually with a knife transverse to the direction in which it travels at a point between the core tube and the roll with the web partly looped around the core tube once a fresh core tube has been positioned in the drum bed. This is very difficult and requires a comparatively long time. Downtime during the change of rolls has regularly been longer than winding time, which is comparatively short because of the great strength of the cellulose web.

SUMMARY OF THE INVENTION

The object of the present invention is a method and device that will shorten changing times.

This object is attained in accordance with the invention with a method wherein the web, which is subjected to tension, is separated by being wetted along a line transverse to the direction in which the web travels at a point that ensures that the core tube will be completely looped and with a device comprising a two-drum winding machine with a contact roll and web-separating mechanism for winding webs of cellulose and with a hollow separating strip that extends across the whole width of the machine and has water outlets along its blade.

In one embodiment of the method, the web is compressed and separated once it has been partly looped around the core tube.

In one embodiment of the machine, the separating strip is mounted on a contact-roll crossbar facing the cellulose web in such a way that it can be displaced.

Another advantage of the invention in addition to that of more rapid roll change is that no out-of-round occurs during winding as has previously resulted from too long a section being separated and having to be wound onto the core tube so that the web has had to be initially rolled up in two layers before the overall initial web section as a whole could be wound on the core tube. Manual labor is also saved because all the procedures involved in changing the rolls are performed by machine.

A preferred embodiment of the invention will now be described with reference to the attached drawings, wherein

DETAILED DESCRIPTION OF A PREFERRED EMBODIMENT

Figure 1:
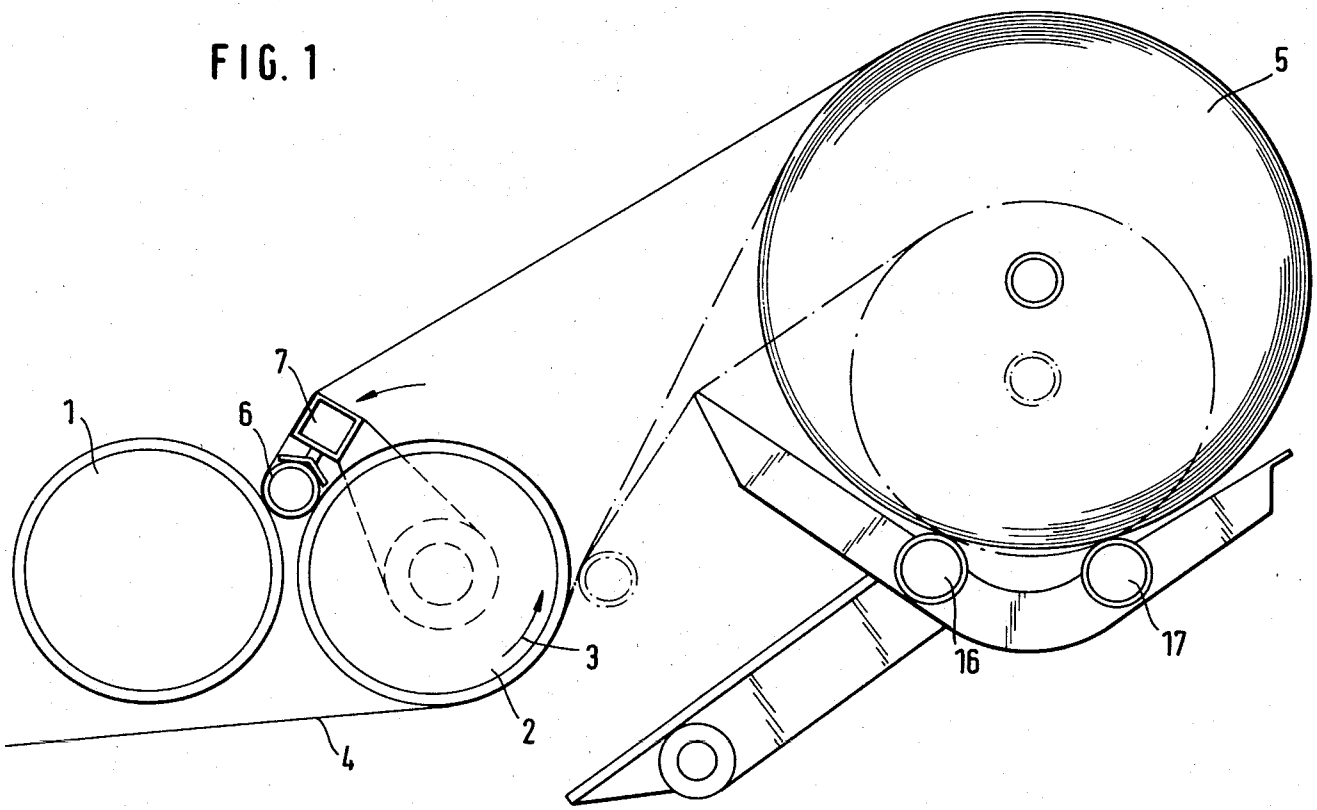
FIG. 1 is a schematic side view of a two-drum winding machine while a core tube is being inserted.

The double-drum winding machine consists of drums 1 and 2, at least one of which is powered in the direction indicated by arrow 3. A cellulose web 4 is wound on a roll 5, which is in the transporting-off position, and partly looped around drum 2.

A core tube 6 is inserted in the drum bed with a tube inserter 7 that swings around drum 2 as illustrated in FIG. 1.

Figure 2:
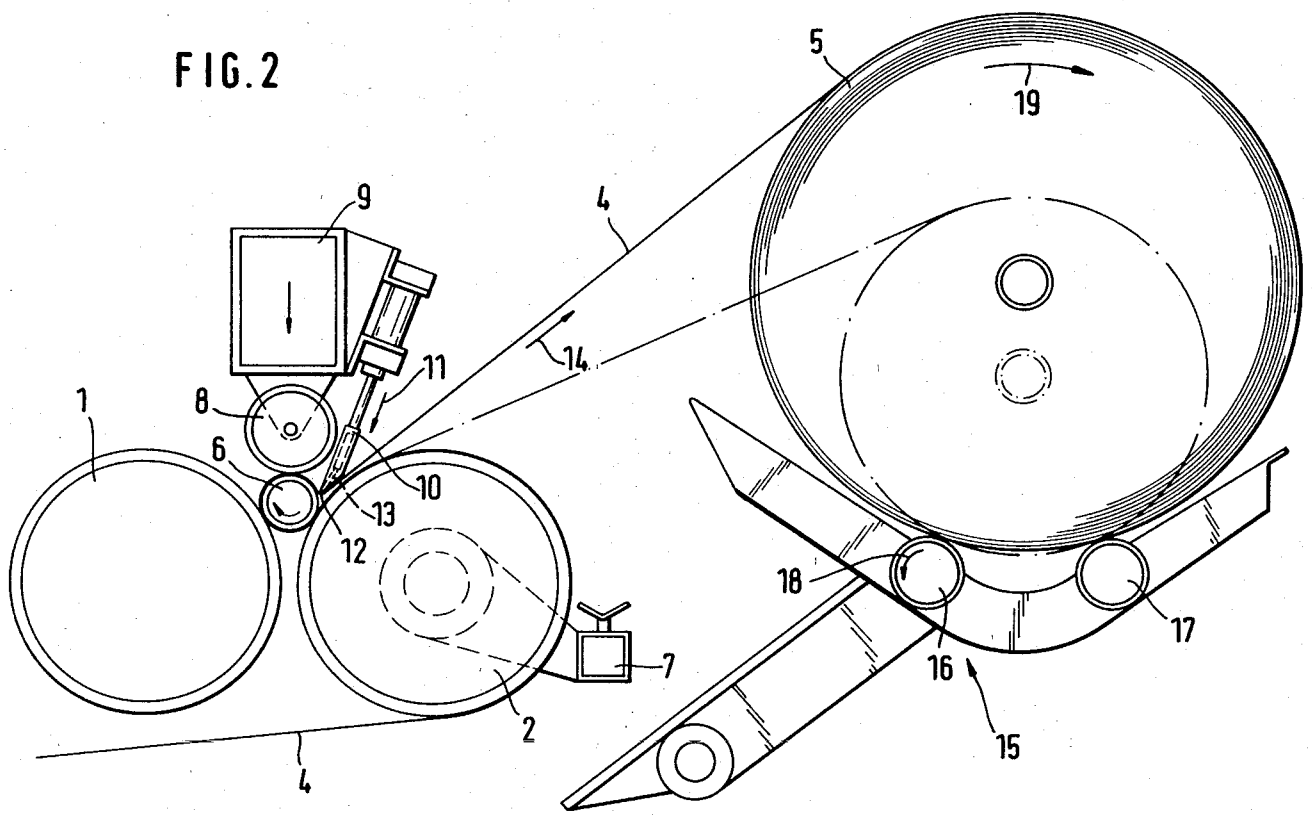
FIG. 2 is a schematic side view of the machine during the separation process.

Once tube inserter 7 has swung back into the position illustrated in FIG. 2, a contact roll 8 can be dropped into contact with core tube 6.

A hollow separating strip 10 is mounted on a contact-roll crossbar 9 facing cellulose web 4 in such a way that it can be displaced in the direction indicated by arrow 11. There are water outlets 13 along the blade 12 of separating strip 10. Water arrives on cellulose web 4 through outlets 13 along a line transverse to the direction in which the web travels. The amount of water needed to separate web 4 is very slight. When water can be induced to arrive along the whole line across the total width of web 4, a tug on the web in the direction indicated by arrow 14 will immediately separate the web. A tug can be applied to web 4 in the direction indicated by arrow 14 by swinging roll 5 down with dropping mechanism 15 or rotating one of two rolls 16 and 17 in the direction indicated by arrow 18, rotating roll 5 in turn in the direction indicated by arrow 19. This rotation can be maintained once web 4 has been separated in order to wind the end of the web.

As FIG. 2 indicates, separating strip 10 is positioned so that web 4 is separated between core tube 6 and drum 2 in such a way that the tube will be completely looped and no out-of-round will occur.

It is understood that the specification and examples are illustrative but not limitative of the present invention and that other embodiments within the spirit and scope of the invention will suggest themselves to those skilled in the art.

We claim:

1. In a method of winding a web of cellulose on a core tube while under tension, wherein the web is separated after a predetermined amount of web has been wound on a first core tube, the improvement wherein: prior to separation, the web is partly looped around a next core tube to be wound while still under tension, forced down to almost completely wrap around said next core tube and wetted transversely to the direction of travel to effect separation while ensuring that said next core tube is completely looped.

2. The method according to claim 1, wherein the web is separated by rotating the first core tube after wetting.

3. In an apparatus for winding a web of cellulose on a core tube while under tension, including means for separating the web after a predetermined amount of web has been wound on a first core tube, the improvement comprising means for partly looping the web around a next core tube prior to separation of the web and while the web is still under tension, means for forcing the web down to almost completely wrap around said next core tube and for wetting the web transversely to the direction of travel to effect separation while ensuring that said next core tube is completely looped.

4. The apparatus according to claim 3, wherein the means for separating includes means for rotating the first core tube after wetting.

* * * * *